United States Patent [19]

Bresie et al.

[11] 4,213,476

[45] Jul. 22, 1980

[54] METHOD AND SYSTEM FOR PRODUCING AND TRANSPORTING NATURAL GAS

[75] Inventors: Don A. Bresie; Donald W. Fowler; Jack M. Burns, all of Austin, Tex.

[73] Assignee: Texas Gas Transport Company, Austin, Tex.

[21] Appl. No.: 11,683

[22] Filed: Feb. 12, 1979

[51] Int. Cl.[2] ..... F17C 5/02

[52] U.S. Cl. ..... 137/2; 166/75 R; 166/314; 166/267; 62/55; 48/190

[58] Field of Search ..... 166/244, 75 R, 314, 166/265, 266, 267; 137/1, 2, 121, 119, 569; 62/55; 48/190

[56] References Cited

U.S. PATENT DOCUMENTS

| | | | |
|---|---|---|---|
| 2,779,348 | 1/1957 | Robertson | 137/121 |
| 2,780,231 | 2/1957 | Westmoreland | 137/121 |
| 3,232,725 | 2/1966 | Secord | 48/190 |
| 3,293,011 | 12/1966 | Lewis | 48/190 |

*Primary Examiner*—Alan Cohan

*Attorney, Agent, or Firm*—Bacon & Thomas

[57] ABSTRACT

Natural gas taken from a gas well is loaded continuously and at a preselected, generally uniform rate into a movable separate pressure vessel means until such is filled with a discrete batch of natural gas at a pressure in excess of 800 psia, whereupon it is replaced with another separate pressure vessel means, with no interruption of gas flow. The filled, movable vessel means is then transported to an off-loading terminal. Well shock is thus controlled, and maximum natural gas recovery obtained. A generally uniform flow rate is obtained by a regulating valve, when well head pressure exceeds about 800 psia, and by a compressor when the well head pressure is below such value.

16 Claims, 5 Drawing Figures

METHOD AND SYSTEM FOR PRODUCING AND TRANSPORTING NATURAL GAS

TECHNICAL FIELD OF THE INVENTION

This invention relates generally to a method and system for producing and transporting natural gas, particularly from so-called shut-in gas wells. More specifically, it relates to a method and system for continuously producing natural gas in a manner which minimizes gas well shock problems and maximizes the amount of natural gas recovered, and wherein the natural gas is transported from the well head in discrete batches under high pressure, within movable high pressure vessels requiring no insulation or refrigeration.

BACKGROUND OF THE INVENTION

The use of natural gas as an energy source has become worldwide, and demand for the fuel is increasing. Natural gas wells now exist in large numbers in many locations across the earth and new wells are being found as a result of exploration activity that is increasing in this time of a growing energy shortage. Many natural gas wells are located close to existing or planned pipelines which, in most instances, provide an efficient and practical means to transport their natural gas from the well head to a terminal facility or place of use.

But a great many other natural gas wells are not presently found on or near a pipeline and, of these, many are so located that the economic and engineering problems associated with connecting them to a pipeline have the practical effect of precluding this occurring. These are referred to as shut-in gas wells, and there are several reasons why connecting them with a pipeline cannot be expected to occur.

Some shut-in gas wells are located where pipeline construction is very difficult and expensive, such as in deep water off shore. Others are scattered in small numbers across large geographic areas, and the amount of natural gas which can be recovered from them will simply not support the building of a pipeline. In other instances, it might prove economical to build a pipeline to the well head, if the amount of producible natural gas could be determined; but no practical, efficient method has been available in the past to determine expected production and thus such gas wells remain shut-in.

The amount of natural gas found in these shut-in gas wells is enormous, and efforts have been made to find a means of recovery that is at once practical and economical. But despite the work of many, the problem remained unsolved until the development of the invention entitled "Method and System for Transporting Natural Gas to a Pipeline", which is the subject of United States patent application, Ser. No. 912,853, filed June 5, 1978, now U.S. Pat. No. 4,139,019.

Until the invention which is described in this noted earlier application and patent, there were in use essentially only two techniques for transporting natural gas from the well head. The first was the pipeline, and its limitations have already been noted. The second was by a cryogenic technique in which the natural gas is refrigerated until it reaches a liquid state, and the liquefied natural gas is then placed within heavily insulated vessels which are transported under refrigerated conditions from the gas well location to an off-loading terminal. Examples of the second, liquefied natural gas transportation technique are described in U.S. Pat. Nos. 3,232,725 and 3,298,805. The liquefied natural gas transportation technique is very expensive to utilize, and requires the movement of very large volumes of natural gas from one location to another in order to be economically feasible. Further, because of economics and the heavy weight of the required equipment, the technique is usually only feasible when the vessels are mounted on ships for movement in water. Thus, the liquefied natural gas technique is simply not practical for use with most shut-in gas wells particularly those found in isolated, scattered locations on land.

In the method and apparatus of the invention of application Ser. No. 912,853, the natural gas is transported in discrete batches under high pressure within uninsulated and unrefrigerated, movable high pressure vessels, which can be carried by truck, train, water-borne craft or other suitable vehicles. The technique is practical from the standpoint of both engineering and economic feasibility for use with nearly all shut-in gas wells and thus for the first time makes available the vast natural gas reserves found in those gas wells.

The desire when taking natural gas from a gas well is of course to recover the maximum amount, and this becomes especially important when working with small numbers of isolated, shut-in gas wells of somewhat limited capacity. In the latter instances, the ability to recover the maximum amount of natural gas can make the difference between an economically successful project and one that might fail financially, and thus prove unfeasible. The present invention, which is an improvement on the invention of application Ser. No. 912,853 is particularly directed to assuring the maximum recovery of natural gas from a gas well.

It has been discovered that natural gas recovery can be hindered if the gas well is handled in a manner to shock the well. Well shock can occur from different causes and is generally defined for purposes of this invention as structural damage or problems occurring in the gas well during withdrawals therefrom, and which act to limit the recovery of natural gas therefrom.

It is known that natural gas produced from some underground reservoirs will have liquids associated therewith, which may be in the form of condensed hydrocarbon gases, called condensate, or water. Their presence can affect the flowing characteristics of the well, and it has been found preferable to transport the liquids to the surface by the natural gas flow. If the natural gas flow rate is not sufficient to lift the liquids out of the well, they can accumulate and impose an additional back pressure on the formation which can act to significantly affect the natural gas production capacity of the well or even render it incapable of production.

It is not uncommon for a gas well to begin production, but then to be affected by liquids in such a manner as to reduce or close down production. Obviously, when this type of well problem occurs, the natural gas recovery is affected. We have discovered this problem can be alleviated by carefully choosing the flow rate for the natural gas.

It has also been found that well shock can occur from changes in the velocity gradient in the well bore, which can cause a "sanding up" problem with the gas well. This form of well shock can be caused by high flow rates of gas, accompanied by intermittent flows, such as might result when large vessels are periodically filled from a gas well. The present invention addresses this problem, also.

Given the need for increased production of natural gas present in the world today, it is desirable to recover the maximum amount of natural gas from all gas wells. This is particularly important when working with shut-in wells, to be certain that the recovery operation is made economically feasible. There is thus need for an improved method and system for producing and transporting natural gas from shut-in wells, one which will minimize well shock, and the adverse effects thereof, and assure maximum natural gas recovery. The present invention is intended to satisfy that need.

BRIEF SUMMARY OF THE INVENTION

The present invention includes a new method for producing an transporting natural gas, which is an improvement upon that disclosed in prior patent application Ser. No. 912,853. Further, the present invention also includes an improved system for producing and transporting natural gas, wherein a new and unique arrangement of apparatus produces results which are superior to those obtainable with the arrangement of the earlier invention.

We have discovered that maximum recovery of natural gas from a gas well can be best assured by continuously withdrawing the natural gas at a flow rate which has been carefully calculated to take into account the characteristics of the well. When this is done, well shock is held to a minimum and the life of the gas well is prolonged.

Further, with continuous withdrawal of the natural gas, the casing head gas produced along with oil from those wells which simultaneously produce both petroleum and natural gas can be continuously recovered. In the past such wells have proved a special problem, since it was desired to keep petroleum withdrawal continuous, but no means was available to continuously take off the natural gas except to burn it on site in what is called a flaring process. It is of course recognized today that the needless flaring of natural gas is a waste of this valuable resource and, in fact, many governments have adopted "no flare" regulations. Thus, unless the natural gas can be continuously recovered, production may need to be stopped. When this occurs, the well can become shut-in for both petroleum and natural gas. With the present invention, these wells can be placed in use.

In the method of the present invention, continuous production is achieved by using at least two high pressure vessels to receive the discrete batches of natural gas for transportation to an off-loading terminal. The apparatus of the system is designed to ensure easy changeover from one high pressure vessel to another, with no disruption in the flow of the natural gas from the gas well. Moreover, the apparatus of the system is designed to ensure an even flow rate, the combination of an even flow rate and continuous production being effective to minimize well shock and assure maximum natural gas recovery.

As the first step of the present method, the preferred withdrawal rate for the gas well must be determined. Then, the gas well is connected to loading apparatus leading to two high pressure vessels, the loading apparatus functioning in a manner to regulate the flow rate to keep it substantially even with the preferred withdrawal rate, and to maintain a continuous natural gas flow from the well.

The present invention utilizes essentially the same high pressure transport technique as is described in prior patent application Ser. No. 912,853, and the apparatus of the present invention is designed to accommodate this technique. In some instances, the well head pressure will be sufficiently high so that the natural gas can be loaded into the high pressure vessels at the desired pressure, without the need for using a compressor. But in other instances, it is necessary to utilize a compressor to attain the necessary pressures. Embodiments of both arrangements are described in this application.

The present invention also includes a compressor arrangement, which is improved over the compressor arrangement shown and described in prior application Ser. No. 912,853. In the present invention, a bypass conduit is connected across the compressor and includes a dump valve that is operated by pressure taken from a point downstream of the compressor outlet, near the high pressure vessel being filled. A check valve is located between this pressure tap point and the compressor bypass conduit. When pressure within the connected high pressure vessel builds beyond a preselected value, the dump valve of the bypass line is opened, to recirculate the natural gas from the compressor outlet back to the inlet of the compressor. At the same time, the check valve prevents pressure from the connected high pressure vessel from reaching the outlet of the compressor. As a result, the compressor is placed in an easy idle mode, which saves operating energy and prolongs its life.

It is contemplated that in many instances, particularly for smaller, more isolated gas wells, the changeover from one high pressure vessel to the other during loading will be accomplished manually, but, of course, in such a manner as to assure the desired natural gas flow continuity. But the invention also includes apparatus for accomplishing an automatic switchover from one high pressure vessel to another. A switchover flow control valve is connected between the loading conduits leading from the loading manifold, and is controlled by a controller which is connected to both loading conduits through a shuttle check valve. With this arrangement, whenever the natural gas fills the first high pressure vessel sufficiently so that the preselected pressure is obtained, the switchover flow control valve is automatically operated to switch loading to the other high pressure vessel.

It is the principal object of the present invention to provide an improved method and system for producing and transporting natural gas from a gas well, wherein well shock is minimized and the maximum recovery of natural gas is assured.

Another object is to provide a method and system adapted for use in transporting natural gas in discrete batches using high pressure vessels which are neither insulated nor refrigerated, wherein the economic conditions associated with such discrete batch transporting are maximized.

Yet another object is to provide a system for continuously loading natural gas from a gas well into pressure vessels or the like.

It is also an object to provide an improved compressor arrangement for a natural gas loading apparatus, designed to reduce energy demands and wear when the compressor is not required for generating loading pressures.

Another object is to provide loading apparatus arranged to automatically switch from one high pressure vessel to another, when the first pressure vessel is filled to the desired pressure.

Other objects and many of the attendant advantages of the invention will become readily apparent from the following description of the preferred embodiments, when taken in conjunction with the accompanying drawings.

BRIEF DESCRIPTION OF THE DRAWINGS

With respect to the attached drawings.

DETAILED DESCRIPTION OF THE PREFERRED EMBODIMENTS

Whereas prior patent application Ser. No. 912,853 described both the loading and the off-loading facilities associated with the method of the invention of said application, the present invention is concerned only with the loading method and facilities for taking natural gas from gas wells and placing it in discrete batches into pressure vessels under high pressure. While the movable high pressure vessels herein are shown to be transported by truck, this is only for purposes of illustration. The movable pressure vessels might also be mounted on a water-borne vessel, a railroad car, or even in an aircraft.

The method of the present invention, as has been noted, contemplates the substantially continuous loading of natural gas into high pressure vessels from a gas well, at a substantially constant, preselected flow rate. The preferred arrangements of components in the present system which are utilized to carry out the method will first be described, followed by further discussion of the method itself.

Figure 1:
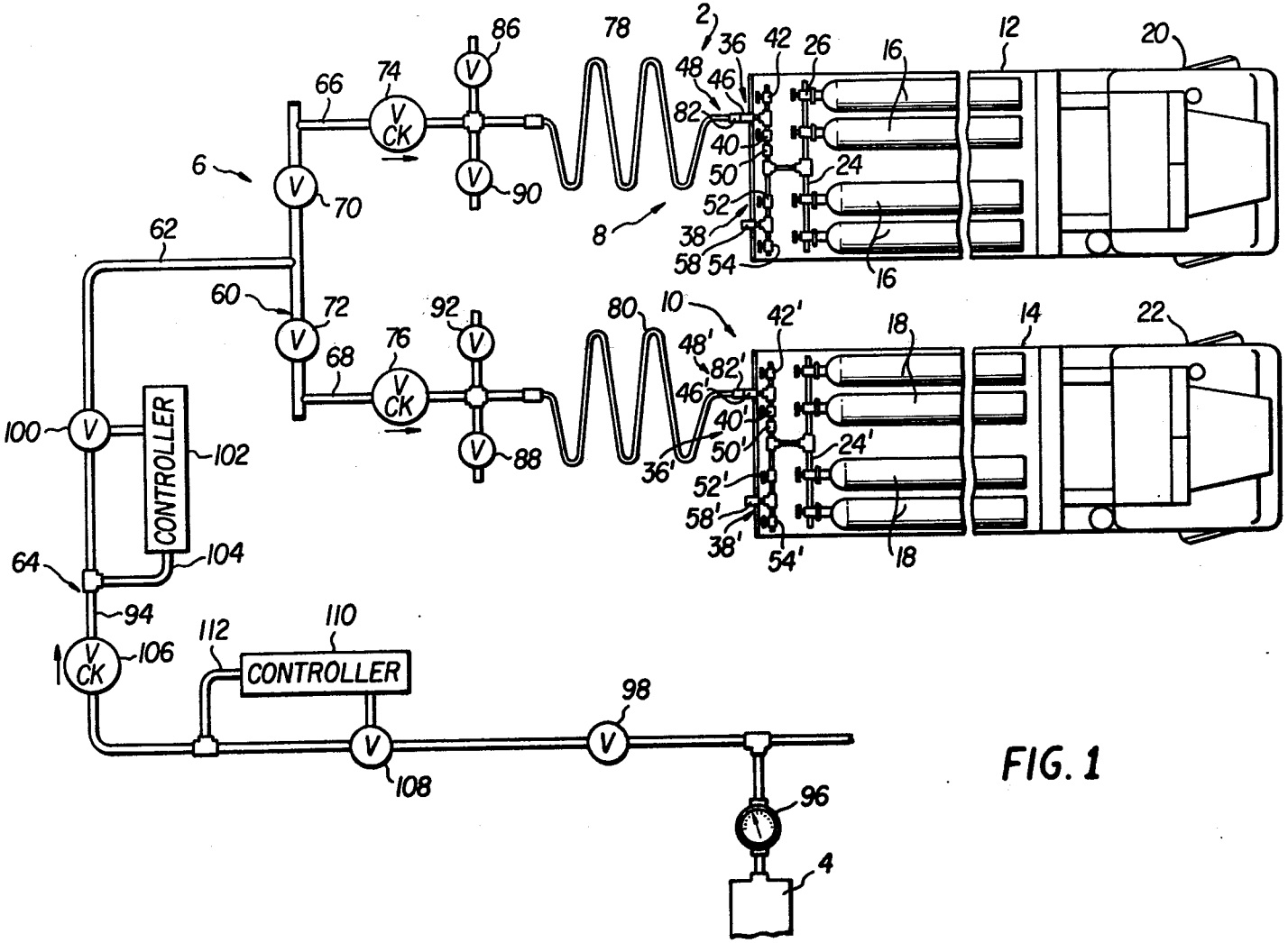
FIG. 1 is a diagrammatic view of a first embodiment of the loading terminal of the invention, showing the apparatus of the system in its simplest form for use in loading natural gas from a high pressure gas well.

Referring now to FIG. 1 of the drawings, a loading terminal is indicated generally at 2, and is located at a gas well site, a gas well being indicated at 4. The loading terminal 2 includes a loading manifold system 6 having two loading locations or stations 8 and 10, for receiving high pressure vessels to be loaded. In the drawing, two semitrailer vehicles 12 and 14 are shown parked in the stations 8 and 10, respectively, the semitrailers respectively carrying high pressure vessels 16 and 18 thereon, and having motorized cabs 20 and 22 connected thereto. It is again noted that high pressure vessels 16 and 18 are shown to be truck-mounted only for purposes of illustration. It is important to the invention that at least one of the high pressure vessels be movable, by truck, train, watercraft or the like, so that it can transport discrete batches of natural gas from one location to another. In the invention, there must be at least two separate high pressure vessels, in order to practice the present method.

Figure 3:
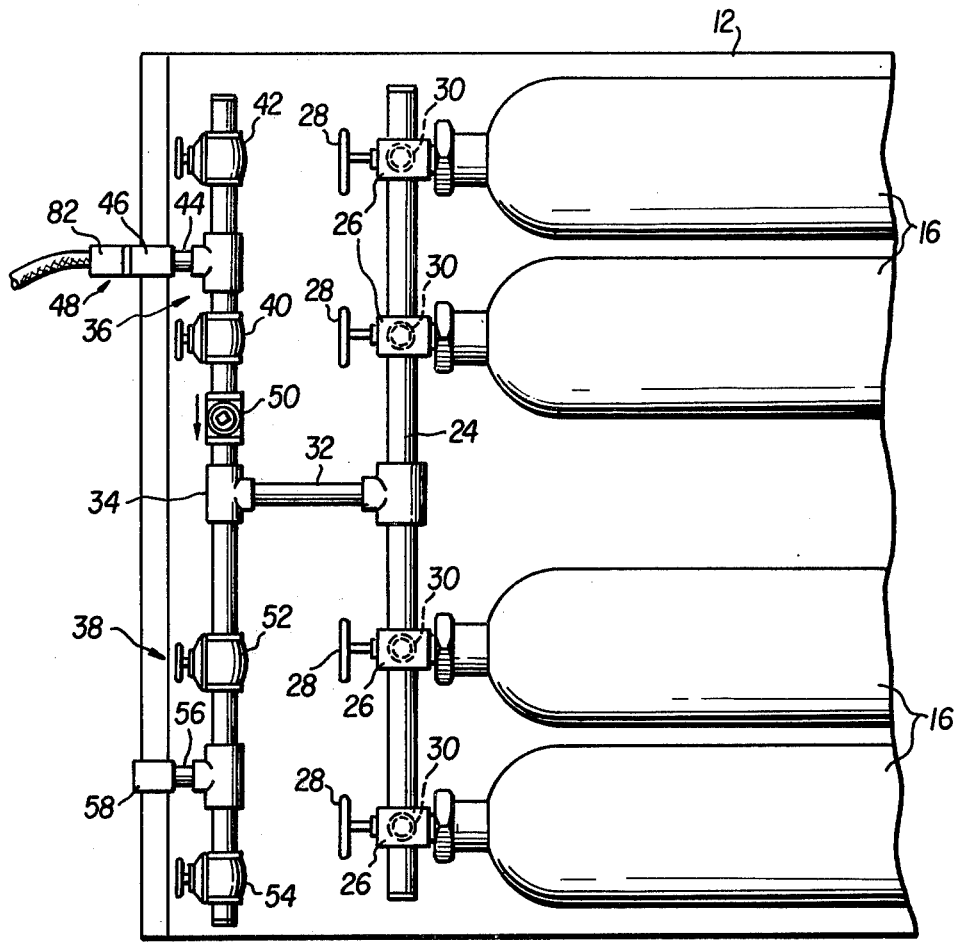
FIG. 3 is an enlarged fragmentary diagrammatic view showing the loading manifold arrangement associated with the high pressure vessels.

The high pressure vessels 16 and 18 can be of any suitable design, but must be capable of safely containing a discrete batch of natural gas at pressures up to about 3,000 psia and above. Usually a number of pressure vessels will be mounted on each vehicle, all of which will be connected to a common manifold arrangement. Referring now to FIG. 3, the high pressure vessels 16 are all shown connected to a vessel manifold 24 by individual valves 26 provided with turning handles 28, and each including a safety rupture disk 30 to provide emergency pressure relief in case overpressurization should occur even while the associated valve 26 is closed.

The vessel manifold 24 has a transfer conduit 32 connected thereto, the outer end of which carries a T-fitting 34. A loading conduit system 36 is connected to one side of the T-fitting 34 and an off-loading conduit system 38 is connected to the other side thereof. The loading conduit system 36 includes a flow control valve 40, a bleed valve 42, and an inlet stub 44 disposed therebetween which carries one-half 46 of a coupling 48. A one-way check valve 50 is positioned between the flow control valve 40 and the T-fitting 34, to prevent back-flow.

The off-loading conduit system 38 includes a flow control valve 52 and a bleed valve 54, between which is positioned a discharge stub 56 carrying one-half 58 of a coupling. The arrangement of the loading and off-loading conduit systems 36 and 38 are like those in prior application Ser. No. 912,853 and function in the same manner. Further, the pressure vessel 18 is fitted with comparable loading and off-loading conduit systems 36′ and 38′, including flow control valves 40′ and 52′, bleed valves 42′ and 54′, a check valve 50′, and coupling valves 46′ and 58′.

As noted in prior application Ser. No. 912,853, the purpose for the bleed valves 42, 42′, 54 and 54′ is to relieve pressure in the system before uncoupling occurs. It would be possible to eliminate the loading conduit systems 36 and 36′ and rely only on the off-loading conduit systems 38 and 38′ to perform both loading and off-loading functions. However, the separate loading conduit systems with their additional couplings and the check valves 50 and 50′ provide additional safety, in that a ruptured load line will not cause the high pressure vessels to exhaust, since the check valves would stop the flow. It may be desirable to add further relief devices to the system for additional back-up safety purposes.

Returning now to FIG. 1, the loading manifold system 6 includes a loading manifold 60 supplied centrally by a feed conduit 62 leading from a gathering manifold system 64, and having supply conduits 66 and 68 connected to its opposite ends which lead to the loading stations 8 and 10, respectively. Two cut-off valves 70 and 72 are positioned in the loading manifold 60, one on each side of the feed conduit 62, and serve to control natural gas flow to the loading stations. One-way check valves 74 and 76, respectively, are positioned in the supply conduits 66 and 68, and said conduits terminate in flexible or adjustable load lines 78 and 80 that have coupling halves 82 and 84 on their outer ends for mating with the coupling halves 46 and 46′, respectively. The check valves 74 and 76 prevent back-flows, and between the check valves and the load lines 78 and 80, the supply conduits 66 and 68 each have a bleed valve 86 or 88 and a pressure relief valve 90 or 92, respectively, connected thereto. The bleed valves 86 and 88 are used to relieve pressure within the system after the associated cut-off valve 70 and 72 is closed and before the coupling halves 82,46 or 84,46' are uncoupled.

The couplings used between the load lines 78 and 80 and the loading conduit systems 36 and 36' are a matter of choice, but preferably such will be of the quick connect-disconnect type. The pressure relief valves 90 and 92 are back-up, the operating pressure therefor being set at a level to assure safety for the system and its operators.

Figure 2:
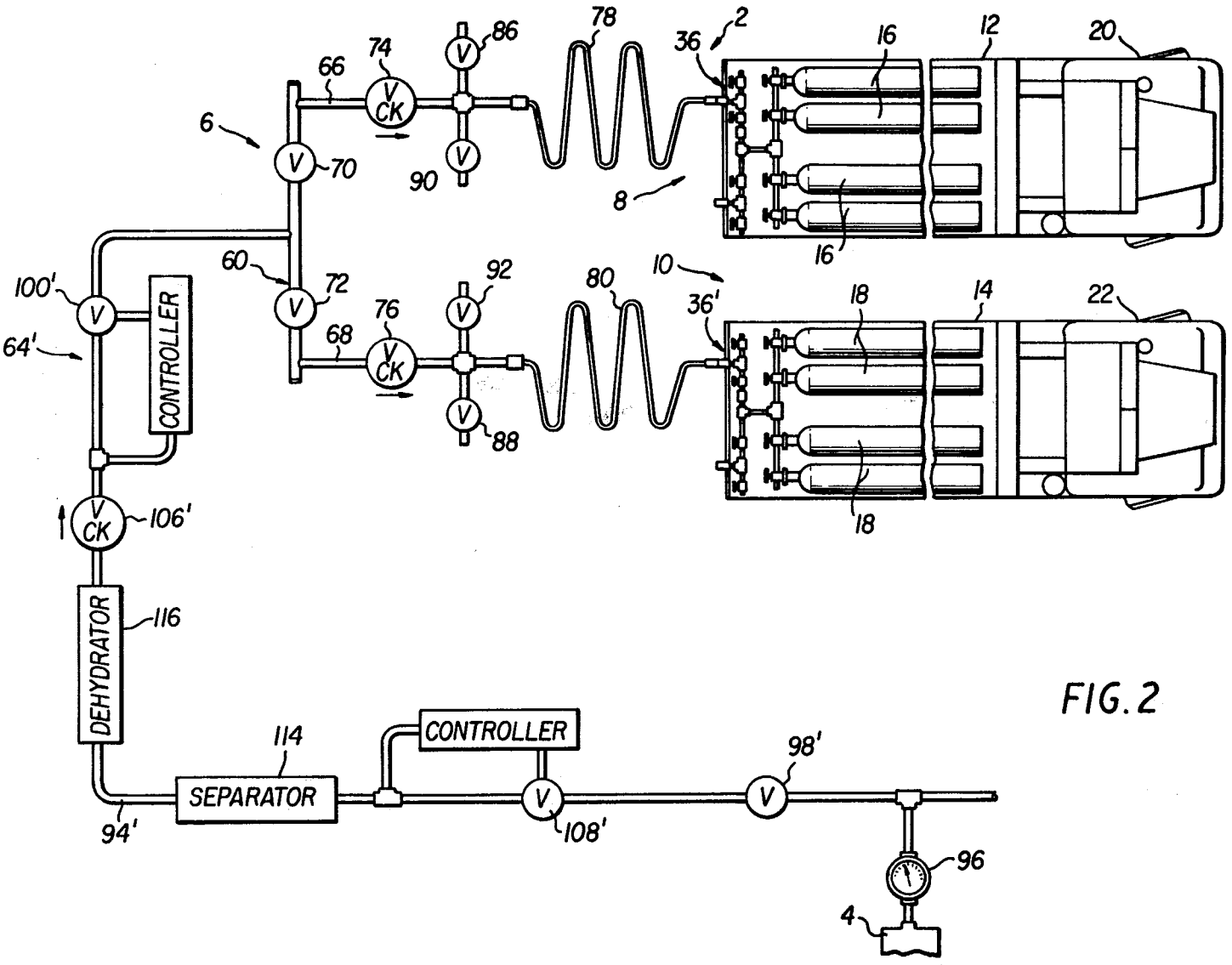
FIG. 2 is a diagrammatic view similar to FIG. 1, but including additionally a separator and dehydrator in the conduit arrangement leading from the gas well to the high pressure vessels.
Figure 4:
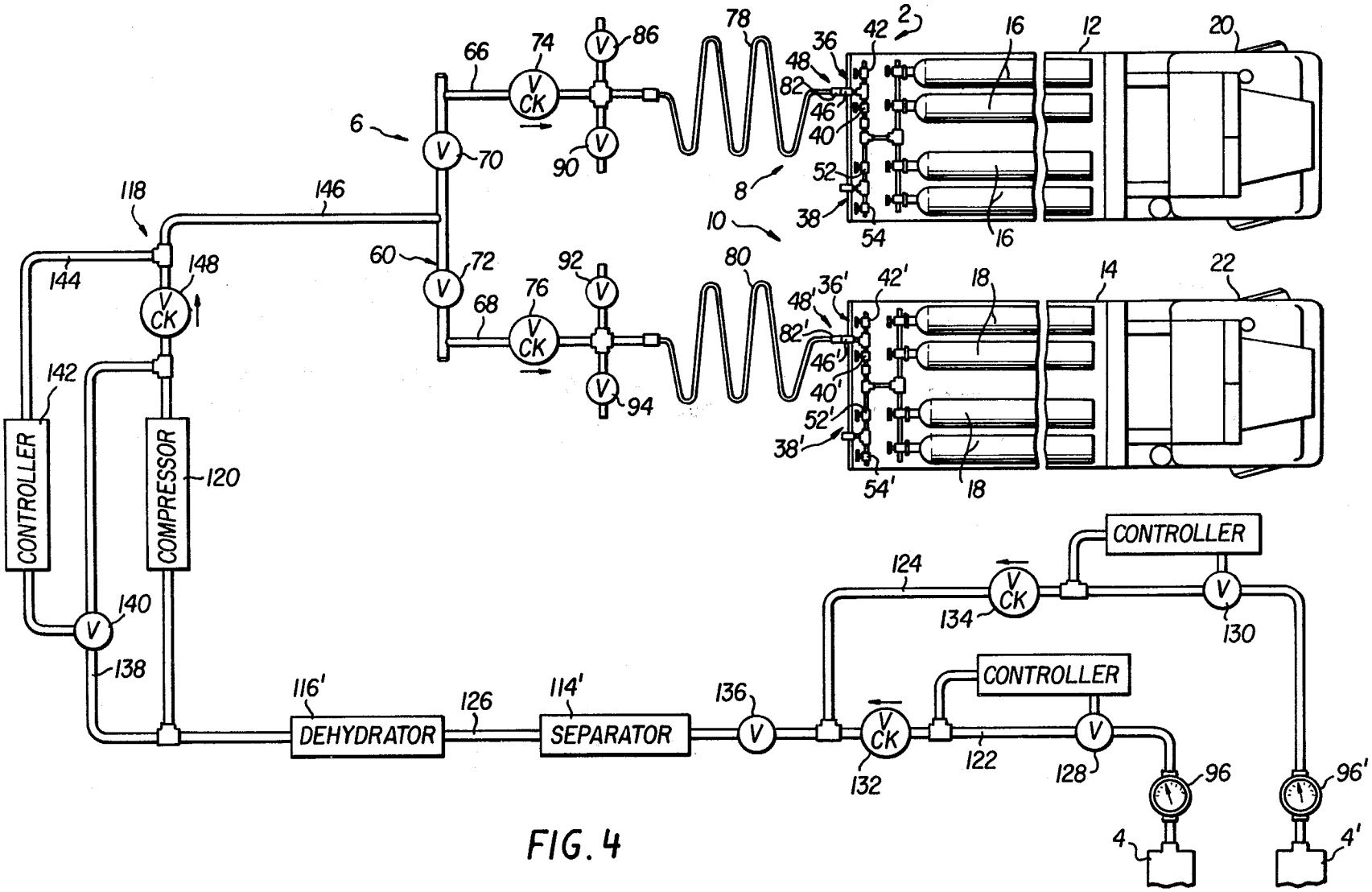
FIG. 4 is a diagrammatic view similar to FIG. 2, but showing a loading terminal incorporating a compressor for increasing the pressure of the natural gas taken from a gas well, the compressor arrangement including a bypass conduit having a flow control valve controlled by downstream pressure.

The loading manifold system 6 is identical in FIGS. 1, 2 and 4 of the drawings, as are the arrangements of the loading stations and the high pressure vessels, and the loading conduit systems 36 and 36'. Thus, these elements of the system will not be further described as these FIGS. are discussed.

Turning now to the gathering manifold system 64 of FIG. 1, such includes a manifold conduit 94 to which the gas well 4 is connected through appropriate gauging equipment 96. A main shut-off valve 98 is located near the well head to control natural gas flow from connected gas wells 4. When two or more gas wells are connected to the manifold conduit 94, check valves (not shown) are mounted at each gas well to prevent back-flow thereinto from another well.

The assumption in FIG. 1 is that the gas well 4 will produce natural gas at a pressure sufficient to load the high pressure vessels, that is, at a pressure in excess of about 800 psia, and preferably in the range of between about 2,000 psia and about 3,000 psia. Under these conditions, no mechanical compression of the natural gas is required; but, in accordance with the teachings of the present method, it is necessary that the flow rate of the natural gas be carefully controlled to conform to a selected value.

In order to control the rate of flow, a flow regulating valve 100 is positioned in the manifold conduit 94, the feed conduit 62 being connected to the outlet thereof. The regulating valve 100 is controlled by a controller 102 connected thereto, and which includes a pressure tap line 104 connected with the manifold conduit 94 upstream of the regulating valve 100.

The flow regulating valve 100 can be of any suitable design, of the type which in effect functions as a variable orifice. A suitable valve is the commercially available "Fisher D Globe Style Valve", with a "4100 Series Controller", configured in the back pressure arrangement. The flow regulating valve 100 is necessary to carry out the method of the invention in part because when the pressure vessels are empty, the differential pressure between the well head and the vessels is great and flow rates tend to be excessive, of the kind which can cause gas well shock from "sanding up". Further, when the pressure vessels are almost filled, the pressure differential is small and the maximum flow rate is then required to complete the filling operation. The flow regulating valve 100 compensates for these conditions by opening and closing to keep the well head pressure and the flow rate approximately constant, thus preventing either excessive flow in the first part of the loading operation or excessively slow loading during the last portion. This in turn helps to control gas well shock and assure maximum natural gas recovery.

A one-way check valve 106 is positioned upstream of the flow regulating valve 100 and its pressure tap line 104 to prevent back-flow towards the gas wells. For the situation of a gas well producing natural gas at a pressure well within the operating demands of the present method, the gas gathering manifold system 64 as thus far described will suffice in some instances. But often, a gas well connected to the gathering manifold system will produce natural gas at pressures considerably in excess of the desired pressure range and, when this occurs, it is necessary to place a high/low safety cut-off valve 108 into the system as shown in FIG. 1.

The high/low safety cut-off valve 108 is positioned between the check valve 106 and the well head, and a separate one should be used for each gas well where the problem of excessive pressure is found. The valve 108 is operated by a controller 110, provided with a pressure tap line 112 that connects downstream of the valve 108 with the manifold conduit 94 at a point before the check valve 106. The high/low cut-off valve 108 is designed to shut the gas well down if one of two conditions exist. The first condition is if pressure in the manifold conduit 94 exceeds the safe loading pressure of the tanks. The second is if the pressure in the manifold conduit 94 becomes very low, as might happen in the case of a broken conduit or the like. The arrangement is such that the high/low cut-off valve 108 will close if either condition occurs and, otherwise, it will remain open, which is its normal operating position. Such high/low safety cut-off valves are known, and a suitable commercially available one for use with the invention is identified as the "Cameron Type FB High/Low Well Head Valve".

The arrangement of FIG. 1 assumes that the natural gas withdrawn from the gas well 4 and any other connected wells will be relatively pure and free from moisture. This will in fact sometimes occur. But more commonly, the natural gas will be mixed with liquid petroleum or the like, and may contain water. The method of the invention functions best when these are removed before the natural gas is loaded into the pressure vessels, and a system similar to FIG. 1, but which will provide for such removal, is shown in FIG. 2.

The system of FIG. 2 is identical to that of FIG. 1, except that in the gathering manifold system 64', a gas-/oil separator 114 is positioned after the high/low safety cut-off valve 108' and before the check valve 106', and a dehydrator unit 116 is placed after the gas-/oil separator 114, all in the manifold conduit 94'. The separator and dehydrator units 114 and 116 are of known construction, with the former being designed to separate out from the natural gas any oil or hydrocarbon condensates, and the latter any vapor moisture, before it is loaded into the pressure vessels. These units will usually be employed in a working system, in order to ensure that moisture levels in the high pressure vessels will remain low enough to prevent stress-related corrosion of the vessels. The system of FIG. 2 also includes a regulating valve 100' corresponding to the regulating valve 100 in FIG. 1, and a main cut-off valve 98'.

There are many gas wells which produce natural gas at a pressure significantly below the high pressure operating range of the present method and, in these instances, a compressor must be added to the system. Turning now to FIG. 4, a gas gathering manifold system is shown at 118 therein, incorporating a compressor 120. The balance of the system is like that of FIGS. 1 and 2, including the loading manifold system 6, the loading stations 8 and 10, and related components.

In FIG. 4, two gas wells 4 and 4' are shown, each having connected thereto gauging equipment 96 and 96' and a collecting conduit 122 and 124, respectively, which conduits lead to the manifold conduit 126. High/low safety cut-off valves 128 and 130 corresponding to the cut-off valve 108 are positioned in the collecting conduits 122 and 124, respectively, following which are located one-way check valves 132 and 134. The arrangement thus illustrated is usable with FIG. 2, also, to connect a plurality of gas wells, with each having its own high/low safety cut-off valve.

Because in the system of FIG. 4 it is assumed the well head pressures will be below the minimum pressure required to fill the high pressure vessels, the high/low safety cut-off valves 128 and 130 may not be needed to gaurd against high pressures; however, pressure surges in the gas wells will sometimes occur. But in any case, line ruptures are still possible, and the valves 128 and 130 are also designed to effect shut-down if this occurs.

The manifold conduit 126 also has connected therein an oil/gas separator unit 114' and a dehydrator unit 116', following a master flow control shut-off valve 136. The separator unit 114' is positioned before the compressor 120, and the dehydrator unit 116' is shown located between the separator unit and the compressor; however, if desired, the dehydrator unit 116' can also be located after the compressor 120. The flow regulating valve 100 of FIG. 1 is not required in FIG. 4, since the compressor 120 will function to regulate the flow rate of the natural gas to the high pressure vessels.

The compressor 120 has a bypass line 138 connected between its inlet and outlet ends, and which contains a flow control dump valve 140 that is operated by a controller unit 142, the latter including a pressure tap line 144 which connects with the feed conduit 146 of the gathering manifold system 118 downstream of the bypass line 138. A one-way check valve 148 is connected in the feed conduit 146 between the pressure tap line 144 and the bypass line 138.

Once the preferred rate of flow for natural gas from the gas well(s) is determined, the compressor is placed in operation to provide natural gas under high pressure to the high pressure vessels. It is intended that the operation will be substantially continuous, with changeover from one high pressure vessel to another occurring as the first becomes filled. However, it is recognized this might not always occur, for one reason or another, so that some time delay will be present after a high pressure vessel is filled and before an empty vessel is available. In such instance, the compressor bypass line arrangement of the invention comes into use.

Pressure within the feed conduit 146 will start to build up as the pressure vessel connected to the loading manifold system 6 becomes filled. When this pressure exceeds a predetermined value as set on the controller unit 142 and sensed by the pressure tap line 144, the normally closed dump valve 140 will be shifted to its open position, causing the bypass line 138 to begin operation and placing the compressor 120 in an easy idle mode. The compressor will go into an easy idle mode because when the dump valve 140 snaps open, the pressure of the discharge of the compressor 120 is completely relieved, the one-way check valve 148 preventing any feedback of pressure from the pressure vessels or the loading manifold system 6. The compressor 120 will operate in this easy idle mode, with minimum wear and using a minimum of energy, until the pressure downstream of the check valve 148 is relieved.

When pressure downstream of the check valve 148 is relieved, as for example when an empty high pressure vessel is connected to the system, this will be sensed by the controller unit tap line 144. The dump valve 140 will then be closed and the compressor 120 will again be operational to supply natural gas under pressure to the loading manifold system 6. The bypass arrangement helps ensure that overpressurization of the loading manifold system 6 and the pressure vessels will not occur and, in addition, has the salutory effect of reducing the energy requirements of the compressor and lessening wear thereof during periods when natural gas is not being loaded into the high pressure vessels.

In a typical situation, an operator can manipulate the control valves 70 and 72 of the loading manifold system 6 to change from the connected high pressure vessels 16 to the vessels 18, and vice versa, without significantly interrupting natural gas flow. However, the advantages for an automatic system for performing such switchovers are obvious, and such a system is shown in FIG. 5.

Figure 5:
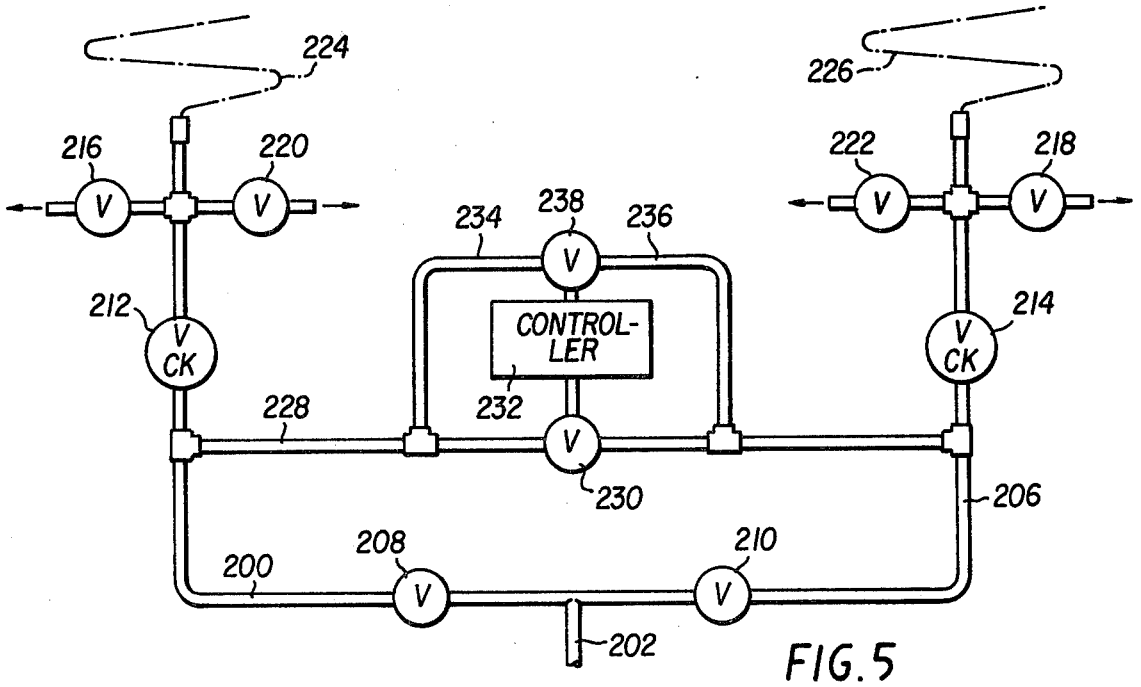
FIG. 5 is an enlarged, fragmentary diagrammatic view showing the automatic switchover loading arrangement of the invention.

Referring now to FIG. 5, a loading manifold 200 is shown supplied with natural gas from a feed conduit 202, and having supply conduits 204 and 206 connected to its opposite ends. The manifold 200 is provided with flow control valves 208 and 210, corresponding to the flow control valves 70 and 72, and the supply conduits have check valves 212 and 214, bleed valves 216 and 218 and pressure relief valves 220 and 222, respectively, connected thereto, corresponding to the check valves 74 and 76, bleed valves 86 and 88, and pressure relief valves 90 and 92 of FIG. 1. Loading lines 224 and 226, respectively, are connected to the outer ends of the supply conduits 204 and 206.

A connecting conduit 228 extends between the supply conduits 204 and 206, and is connected with each thereof between the associated check valve 212 or 214, and the flow control valve 208 or 210. Centrally thereof, the connecting conduit 226 has a switchover control valve 230 therein, operated by a controller unit 232 provided with two pressure tap lines 234 and 236, which are connected to the connecting conduit 228 on opposite sides of the switchover valve 230. The pressure tap lines 234 and 236, respectively, connect to a shuttle check valve 238, which is arranged to sense the highest pressure of the two tap lines 234 and 236 and to permit flow only toward the controller unit 232.

The switchover control valve 230 is initially closed. Thereafter, the shuttle check valve 238 senses the highest of the two operating pressures which exist in the supply conduits 204 and 206 and, when the pressure in one of them exceeds the setting of the controller unit 232, such is effective to open the switchover valve 230. Flow then is directed from the higher pressure supply conduit 204 or 206 to the lower pressure one, with the appropriate check valve 212 or 214 preventing any back-flow from the just filled pressure vessels. Thus, the system is automatically switched from the filled to the empty high pressure vessels.

After this switchover occurs, the flow control valve 208 or 210 which normally feeds the now being filled pressure vessels is opened, whereby the normal filling gas flow is established, and the other control valve 208 or 210 is closed. The supply conduit 206 or 208 leading to the filled pressure vessels is then bled by operating its associated bleed valve 216 or 218, and the fall in pressure in the associated pressure tap line 234 or 236 will be sensed by the controller unit 232 and the switchover valve 230 will close. The filled pressure vessels are then removed and replaced, and the system will thereafter continue in operation until the pressure vessels being filled reach the preselected operating pressure for the controller unit 232, whereupon switchover in the opposite direction will occur.

The switchover arrangement of FIG. 5 helps assure a smooth transition from filled to empty pressure vessels, with substantially no interruption in the continuity of natural gas flow. Further, because the actual switchover occurs automatically, the operator need not be overly attentive to the system and, indeed, is provided with a considerable time period during which to change pressure vessels. This contributes to the safety of the overall system and also helps make it more practical in field operation.

Returning now to the method of the invention, if correctly practiced, such will assure the maximum recovery of natural gas from a gas well and minimize well shock. The first step of the method is to analyze the gas well to determine what the preferred flow rate therefrom ought to be. To do this analysis, factors like the geological structure of the producing formation and of the well, the extent of condensates and water present in the well which must be withdrawn with the natural gas, the nature of the well face and its susceptibility to sanding, the estimated total amount of natural gas in the well, and others, must be reviewed and evaluated. The techniques for accomplishing this analysis are known in the industry and, hence, will not be described in detail herein.

Given the results of this review and evaluation, a preferred rate of withdrawal for the gas well is selected. This will commonly be in the range of from about 10% to 25% of the theoretical maximum withdrawal rate of the well, adjusted to provide minimum well shock under conditions of continuous withdrawal. It should also be noted that the preferred rate of withdrawal can change for a given well over a period of time and, thus, periodic review is desirable to ensure continued maximum natural gas recovery.

Remembering that one of our discoveries is that reduced production from well shock can be minimized by keeping the gas well in continuous production, the next step of the method after determining the preferred rate of withdrawal is to select the preferred number of separate pressure vessel means, and the mode of their operation required to maintain the preferred rate of withdrawal. In most instances, a separate pressure vessel means is defined as a vehicle of suitable design, movable from place to place, and which carries thereon one or more high pressure vessels arranged as described herein. The minimum number of separate pressure vessel means required to practice the method is two; sometimes, however, one or several more separate pressure vessel means may be required for continuous production, or to satisfy the conditions surrounding a given transport situation. At least one separate pressure vessel means must be movable, as has been noted earlier.

There are several factors that must be taken into account when selecting the number of separate pressure vessel means and their mode of operation. These include the holding capacity of the separate pressure vessel means at the selected operating pressure, which will usually be between about 2,000 psia and 3,000 psia, the distance from the loading station to the point where off-loading will occur, the rate at which the off-loading terminal can empty the movable, separate pressure vessel means and make them ready for return, the difficulties encountered by vehicles carrying the pressure vessels as they move from the loading stations to the off-loading terminal, and similar factors. In each case, the search is for a production and transportation system which will maintain the preferred continuous flow rate of the gas well(s) and, at the same time, minimize the costs of recovering and transporting the natural gas.

The type of vehicles used in the movable separate pressure vessel means can be trucks, watercraft, aircraft, or possibly a combination of these. Considering for the moment the semitrailer mounted pressure vessels shown in the drawings, the minimum amount of equipment for practicing the present method would usually be two such semitrailers with their pressure vessels, and one motor cab to move them over the road. For isolated gas wells of limited production capacity and when short haul distances are present, this minimum system might well suffice. Further, in some instances, it is possible that only one separate pressure vessel means would be movable and the other fixed; the necessary switchover to provide continuous gas flow is still possible with this arrangement, with the fixed, separate pressure vessel means itself being periodically emptied.

To determine the adequacy of the equipment, one must calculate the following:

(1) The time required to fill a separate pressure vessel means, which is usually the controlling element; and (2) The cycle time required for an unloading operation, which includes:

a. the time required to unhook a movable filled separate pressure vessel means and ready it for travel;

b. the travel time to and from the off-loading terminal;

c. the time required to unload at the off-loading terminal, which may be controlled by the speed with which the terminal can accept the high pressure natural gas; and d. the time required to connect an empty, movable separate pressure vessel means after it has been returned to the loading station.

If the cycle time is well within the filling time, with some margin for delays, then the minimum amount of equipment will suffice. If not, then normally more vehicles with pressure vessels thereon, each defining a movable separate pressure vessel means, will be required. Among ways in which the tractor-trailer system can be enlarged are the following which, again, are merely offered as examples:

Alternate System A 3 semitrailers with one motor cab.

Alternate System B 4 semitrailers with two motor cabs.

There are of course other variations that can be employed, such as four or six semitrailers, with three or five motor cabs. In each situation, the goal is to minimize costs, while keeping the gas well(s) on continuous production at the preferred withdrawal rate.

After selecting the preferred number of movable and perhaps fixed separate pressure vessel means and their mode of operation, which shall always include at least two separate pressure vessel means, the next step of the method is to connect the two separate pressure vessel means to the loading manifold system. Then, a first, movable one of the separate pressure vessel means is filled with natural gas, the flow rate thereof being regulated to be substantially uniform and in accord with the preferred flow rate determined in the first step of the method, and loading being terminated after the movable, separate pressure vessel means contains a selected discrete batch volume of natural gas in a relatively static confined state, compressed to a pressure in excess of about 800 psia, or up to about 3,000 psia.

The substantially uniform flow of the natural gas is achieved with the flow regulating valve arrangement of FIGS. 1 and 2, when the gas well(s) are producing natural gas at a sufficiently high pressure, or with the compressor arrangement of FIG. 4, if the gas well(s) do not produce natural gas with sufficient well head pressure. If the gas well does not have sufficient head pressure and the compressor is required, then as a preliminary to the filling step, the natural gas is first compressed to a pressure in excess of at least 800 psia.

Turning for a moment now to the desired operating pressure, such should be in excess of about 800 psia, in order to achieve the high pressure necessary according to the invention of application Ser. No. 912,853. Preferably, the pressure achieved in the pressure vessels will be in the range of from about 2,000 psia to about 3,000 psia, with 2,300 psia being a nearly optimum pressure level at which the benefits of supercompressability of the natural gas will be obtained.

The next step of the method is to switch from the first movable separate pressure vessel means to the second pressure vessel means as the first becomes filled, and with no substantial discontinuity of natural gas flow. This switchover, together with the maintenance of a substantially uniform rate of flow, substantially controls gas well shock and, thus, will help assure maximum gas recovery. Then, the second separate pressure vessel means can be filled in the same manner as the first.

The final step of the method is to replace the filled, first movable separate pressure vessel means with an empty movable separate pressure vessel means, to ready the process for a new operating cycle. The filled, first movable separate pressure vessel means is then transported in accordance with the concepts of the invention of application Ser. No. 912,853, with no refrigeration or insulation of the high pressure vessels being required.

As has been described earlier, the automatic switchover equipment of FIG. 5 offers significant benefits and can well perform the penultimate step of the method. But the switchover can also be performed manually if care is used.

In those instances when only two separate pressure vessel means are employed and one thereof is fixed at the gas well location, the switchover from the filled, movable separate pressure vessel means to the fixed pressure vessel means is made in the usual manner, and the filled, movable pressure vessel means is then removed and transported to the off-loading terminal. After emptying, the movable pressure vessel is returned to the gas well location and is reconnected. If the cycle time is short compared to the holding capacity of the fixed pressure vessel means, this can be repeated several or more times before the fixed pressure vessel means must itself be emptied. The time between emptying operations of the fixed pressure vessel means can be extended if the duration of its connection to the natural gas well is minimized; this can sometimes be done in a two pressure vessel system by simply switching over to the movable pressure vessel as soon as it is reconnected.

By increasing the number of movable pressure vessel means, it is possible to further extend the time between emptying of the fixed pressure vessel means. In the instances just described, the fixed pressure vessel means is used essentially to maintain continuous flow from the natural gas well. It must, of course, be itself emptied when it becomes filled.

The continuous production method of the invention, then, can be operated with either all movable, separate pressure vessel means or with a combination of fixed and movable separate pressure vessel means. The conditions and characteristics of a given natural gas well location will usually determine which is the better approach and, in each case, there must be at least two separate pressure vessel means, one of which must be movable so that the natural gas can be transported in discrete batches under the high pressure required with the method.

The fixed, separate pressure vessel can simply be a parked semitrailer with pressure vessels mounted on it, or it can be a large, permanently installed container. It is also contemplated that, in some instances, the fixed separate pressure vessel means could comprise the annular space often found between the inner and outer well casings, when this space is structurally adequate to withstand the high pressures used in the invention.

Obviously, many modifications and variations of the invention are possible. Further, it is evident the method and system as described herein meet the objects set forth hereinabove, and that the invention contributes greatly to the efficient recovery of natural gas from shut-in gas wells.

We claim:

1. The method for producing and transporting natural gas from a gas well(s) location, wherein said gas well(s) is connected with a gathering manifold system and said gathering manifold system is connected with a loading manifold system, said method including the steps of:

connecting a first, movable separate pressure vessel means to said loading manifold system;

filling said first, movable separate pressure vessel means with natural gas transmitted thereto through said gathering manifold system and said loading manifold system, said natural gas being compressed by compressor means provided in said gathering manifold system to a pressure in excess of at least about 800 psia if it is not already at that pressure when entering said gathering manifold system from said gas well(s), said filling of said first, movable separate pressure vessel means being terminated after said pressure vessel means contains a selected discrete batch volume of natural gas in a relatively static confined state compressed to a pressure in excess of at least about 800 psia, and said filling proceeding substantially continuously at a generally constant, preselected rate of flow chosen to maintain a preselected, generally constant preferred rate of withdrawal from said gas well(s);

connecting a second separate pressure vessel means to said loading manifold system, at a time prior to when filling of said first, movable separate pressure vessel means is complete;

switching from said first, movable separate pressure vessel means to said second pressure vessel means when said first, movable separate pressure vessel means becomes filled, without any substantial interruption in flow whereby to maintain a substantially constant natural gas flow;

filling said second separate pressure vessel means in the same manner as said first separate pressure vessel means, while said first, movable separate pressure vessel means is removed and replaced;

replacing said filled, first movable separate pressure vessel means with an empty, movable separate pressure vessel means, while said second pressure vessel means is being filled, and before completion of filling thereof; and transporting said filled, first movable separate pressure vessel to an off-loading terminal, where it is emptied and then returned to said gas well(s) location.

2. The method for producing and transporting natural gas from a gas well(s) location as recited in claim 1, including the preliminary steps before said first-mentioned connecting step of:

selecting a preferred rate for withdrawing natural gas from said gas well(s); and selecting the number of separate pressure vessel means, and the mode of operation thereof, required to maintain the substantially continuous withdrawal of natural gas from said gas well(s) at said preferred rate of withdrawal, with said number of separate pressure vessel means being at least two, and at least one thereof being movable.

3. The method for producing and transporting natural gas from a gas well(s) location as recited in claim 1, wherein said second pressure vessel means is fixed, and wherein after said empty, movable separate pressure vessel means is connected to said loading manifold system, natural gas flow is then switched from said fixed separate pressure vessel means to said empty pressure vessel means.

4. The method for producing said transporting natural gas from a gas well(s) location as recited in claim 1, wherein said second pressure vessel means is also movable, and filling thereof continues until such is filled in the same manner as said first, movable pressure vessel means, at which time switchover to said empty, movable pressure vessel means is made.

5. A system for producing and transporting natural gas from a gas well(s) location to a terminal facility located at a delivery location, including:

at least two separate pressure vessel means, at least one of which is to be movable between said gas well(s) location and said terminal facility, and both of which are capable of containing a discrete batch volume of natural gas compressed to a pressure in excess of about 800 psia;

a gas gathering manifold system connected with said gas well(s), and including means for establishing a generally constant flow of natural gas therethrough at a pressure in excess of about 800 psia; and a loading manifold system connected with said gas gathering manifold system, and including:

at least two loading stations, for simultaneously receiving said separate pressure vessel means;

at least two supply conduit means, one for each of said loading stations, each supply conduit means being detachably connected with an associated one of said separate pressure vessel means when such is received in the associated loading station; and valve means arranged and operable for separately controlling natural gas flow through said plurality of supply conduit means, whereby to control the filling of said separate pressure vessel means with natural gas from said gas gathering manifold system, said valve means and said plurality of supply conduit means including means for effecting automatic switchover from one connected separate pressure vessel means to another, arranged so that a first one of said connected separate pressure vessel means is filled, and then a switchover can be automatically made to a second one of said connected separate pressure vessel means with no substantial interruption in natural gas flow from said gas gathering manifold system.

6. A system for producing and transporting natural gas as recited in claim 5, wherein said gas well(s) produces natural gas at a pressure in excess of about 800 psia, and wherein said means included within said gas gathering manifold system for establishing a generally constant flow of natural gas therethrough includes:

manifold conduit means leading from gas well(s) to said loading manifold system;

a regulating valve connected in said manifold conduit means; and a controller for said regulating valve, including a pressure tap line connected with said manifold conduit means upstream of said regulating valve.

7. A system for producing and transporting natural gas as recited in claim 6, including additionally:

an oil/gas separator connected in said manifold conduit means, before said regulating valve.

8. A system for producing and transporting natural gas as recited in claim 6, including additionally:

a dehydrator unit connected in said manifold conduit means, before said regulating valve.

9. A system for producing and transporting natural gas as recited in claim 6, including additionally:

a one-way check valve connected in said manifold conduit means before said regulating valve, and arranged to permit flow only in a direction toward said regulating valve; and a master flow control shut-off valve located in said manifold conduit means upstream of said check valve.

10. A system for producing and transporting natural gas as recited in claim 9, including additionally:

a high/low flow control safety valve connected in said manifold conduit means between said shut-off valve and said check valve, and including a controller having a pressure tap line connected with said manifold conduit means upstream of said high/low safety valve.

11. A system for producing and transporting natural gas as recited in claim 5, wherein said gas well(s) produces natural gas at a pressure lower than about 800 psia, and wherein said means included within said gas gathering manifold system for establishing a generally constant flow of natural gas therethrough includes:

manifold conduit means leading from said gas well(s) to said loading manifold system;

a compressor connected in said manifold conduit means;

a bypass line connected with said manifold conduit means and connecting the outlet side of said compressor with the inlet side thereof;

dump valve means located in said bypass line;

a controller for said dump valve means including a pressure tap line connected with said manifold conduit means downstream of the point of connection of said bypass line with said manifold conduit means; and a one-way check valve connected in said manifold conduit means between said pressure tap line and said bypass line, and arranged to permit flow only in a direction toward said loading manifold system.

12. A system for producing and transporting natural gas as recited in claim 11, including additionally:

an oil/gas separator connected in said manifold conduit means, before said compressor.

13. A system for producing and transporting natural gas as recited in claim 11, including additionally:

a dehydrator unit connected in said manifold conduit before said loading manifold system.

14. A system for producing and transporting natural gas as recited in claim 5, wherein said valve means for controlling natural gas flow through said plurality of supply conduit means includes a separate flow control valve for each of said supply conduit means, and wherein said loading manifold system further includes:

connector means carried on the outer ends of each supply conduit means, for detachably connecting such with an associated separate pressure vessel means;

a bleed valve connected with each supply conduit means between the said connector means and the said flow control valve associated therewith; and a check valve connected with each supply conduit means between said bleed valve and the said flow control valve associated therewith, and arranged to permit flow only in a direction toward said connector means.

15. A system for producing and transporting natural gas as recited in claim 14, wherein said means for effecting automatic switchover from one connected separate pressure vessel means to another includes:

a connecting conduit extending between and connected at its opposite ends with said two supply conduit means at a point thereon positioned between said check valves and said flow control valves associated therewith;

a switchover valve connected in said connecting conduit;

a controller for said switchover valve, and including two pressure tap lines connected with said connecting conduit on opposite sides of said switchover valve; and a shuttle check valve located between said pressure tap lines, arranged to permit flow only in a direction toward said switchover valve controller.

16. In a system for producing and transporting natural gas from a gas well(s) location to a terminal facility located at a delivery location, said system including a loading manifold system having a pair of loading stations, a pair of separate pressure vessel means receivable in said loading stations, a pair of supply conduit means connected with said loading manifold system and each having connector means on its outer end for detachably connecting with an associated separate pressure vessel means, a gas gathering manifold system for supplying natural gas to said loading manifold system, and a pair of flow control valves, one for controlling the flow of natural gas through each of said supply conduit means, means for effecting automatic switchover from one connected separate pressure vessel means to another with no substantial interruption in natural gas flow from said gas gathering manifold system, including:

a connecting conduit extending between said two supply conduit means and connected at its opposite ends thereto;

bleed valve means and check valve means in each of said supply conduit means, located between the point of connection of said connecting conduit and said connector means, said check valve means being arranged to allow flow only in a direction toward said connector means;

said flow control valves being located upstream of the point of connection of said connecting conduit;

a switchover valve connected in said connecting conduit;

a controller for said switchover valve, and including two pressure tap lines connected with said connecting conduit on opposite sides of said switchover valve; and a shuttle check valve located between said pressure tap lines, arranged to permit flow only in a direction toward said controller;

said controller being effective to operate said switchover valve to switch the flow of natural gas from one connected separate pressure vessel means to another with no substantial interruption in natural gas flow from said gas gathering manifold system.

* * * * *